US011633074B2

(12) United States Patent
Schull

(10) Patent No.: US 11,633,074 B2
(45) Date of Patent: Apr. 25, 2023

(54) SYSTEMS, APPARATUS AND METHODS FOR PELVIC FLOOR MUSCLE DEVELOPMENT

(71) Applicant: Squee, LLC, Mesa, AZ (US)

(72) Inventor: Stephanie Grace Schull, Mesa, AZ (US)

(73) Assignee: Squee LLC, Mesa, AZ (US)

( * ) Notice: Subject to any disclaimer, the term of this patent is extended or adjusted under 35 U.S.C. 154(b) by 806 days.

(21) Appl. No.: 16/063,705

(22) PCT Filed: Jan. 3, 2017

(86) PCT No.: PCT/US2017/012069

§ 371 (c)(1),
(2) Date: Jun. 19, 2018

(87) PCT Pub. No.: WO2017/106882

PCT Pub. Date: Jun. 22, 2017

(65) Prior Publication Data

US 2019/0000280 A1 Jan. 3, 2019

Related U.S. Application Data

(60) Provisional application No. 62/273,869, filed on Dec. 31, 2015.

(51) Int. Cl.

| | |
|---|---|
| ***A47K 7/02*** | (2006.01) |
| ***A61H 19/00*** | (2006.01) |
| ***A61H 23/02*** | (2006.01) |

(52) U.S. Cl.

CPC ..... *A47K 7/028* (2013.01); *A61H 19/44* (2013.01); *A61H 23/02* (2013.01);
(Continued)

(58) Field of Classification Search

CPC ..... A47K 7/028; A61H 19/44; A61H 23/02; A61H 2201/1253; A61H 2201/1635;
(Continued)

(56) References Cited

U.S. PATENT DOCUMENTS 210,427 A * 12/1878 Lovell ..... A47L 13/46 15/148
2,137,958 A * 11/1938 Stepan ..... A47L 13/20 206/820

(Continued)

FOREIGN PATENT DOCUMENTS

| | | | |
|---|---|---|---|
| CA | 2137958 | A1 | 9/1995 |
| EP | 2457620 | A1 | 5/2012 |
| WO | WO-2017106882 | A1 | 6/2017 |

OTHER PUBLICATIONS

LSG Touch, Sexual Fitness Guide, pp. 1-3 (2015) retrieved on Jul. 21, 2022 from <https://web.archive.org/web/20151018090747/http://www.lsg-touch.com/sexual-fitness-guide/>.

(Continued)

*Primary Examiner* — Garrett K Atkinson
(74) *Attorney, Agent, or Firm* — Goodwin Procter LLP

(57) ABSTRACT

Embodiments of the invention provide systems, methods and apparatus for pelvic floor exercise. The invention includes an anchor adapted for insertion into a user's body; a cord coupled to the anchor and adapted to extend external to the user's body when the anchor is inserted internal to the user's body; and a weight system adapted to be removably coupled to the cord. Numerous additional aspects are disclosed.

21 Claims, 11 Drawing Sheets

(52) U.S. Cl.
CPC ..... *A61H 2201/1253* (2013.01); *A61H 2201/169* (2013.01); *A61H 2201/1635* (2013.01); *A61H 2201/1685* (2013.01); *A61H 2201/1688* (2013.01); *A61H 2201/1695* (2013.01)

(58) Field of Classification Search
CPC .... A61H 2201/1685; A61H 2201/1688; A61H 2201/169; A61H 2201/1695; A63B 23/02; A63B 21/062; A63B 21/40
See application file for complete search history.

(56) References Cited

U.S. PATENT DOCUMENTS 2,457,620 A * 12/1948 Abraham ..... G01P 15/08 315/9
3,116,926 A * 1/1964 Owen ..... A63B 59/50 482/109
4,895,363 A * 1/1990 Plevnik ..... A63B 23/20 482/93
5,213,557 A * 5/1993 Firth ..... A63B 23/20 482/93
5,554,092 A * 9/1996 Harpstead ..... A63B 23/20 482/148
6,068,581 A * 5/2000 Anderson ..... A63B 23/20 482/148
6,562,018 B1 * 5/2003 Russell ..... A63B 23/20 604/105
7,686,747 B1 * 3/2010 Blackford ..... A63B 23/20 482/105
8,550,088 B1 * 10/2013 Booher, Sr. ..... A61B 17/4241 128/846
D762,797 S * 8/2016 Pajonk-Taylor ..... D21/787
10,150,001 B1 * 12/2018 Blackford ..... A63B 21/0624
10,729,464 B1 * 8/2020 Booher, Sr. ..... A61F 6/08
2004/0038783 A1 * 2/2004 Hunter ..... A63B 21/06 482/148
2010/0210427 A1 * 8/2010 Yu ..... A63B 21/072 482/93
2012/0053017 A1 * 3/2012 Kushnir ..... A63B 23/20 482/121
2017/0238768 A1 8/2017 Schull

OTHER PUBLICATIONS

PCT/US2017/012069 International Preliminary Report on Patentability dated Jun. 19, 2018.
PCT/US2017/012069 International Search Report and Written Opinion dated Mar. 13, 2017.

* cited by examiner

SYSTEMS, APPARATUS AND METHODS FOR PELVIC FLOOR MUSCLE DEVELOPMENT

RELATED APPLICATIONS

The present application is a § 371 National Stage of International (PCT) Patent Application No. PCT/US2017/012069, filed on Jan. 3, 2017, which claims priority to U.S. Provisional Patent Application No. 62/273,869 filed Dec. 31, 2015. All applications are hereby incorporated herein by reference for all purposes.

FIELD

The invention relates generally to human muscle development and more particularly to systems, apparatus and methods for developing pelvic floor muscles.

BACKGROUND

Pelvic floor strength is of critical importance for improving sexual efficacy and preventing incontinence (fecal, urinary, gas) and pelvic organ prolapse (rectum, bladder, uterus) Estimates in medical studies conclude that 30% to 50% of all women have weak pelvic muscles. Pelvic floor exercise, also known as Kegel exercise, consists of repeatedly contracting and relaxing the muscles that form part of the pelvic floor, now sometimes colloquially referred to as the "Kegel muscles". The exercise needs to be performed multiple times each day, for several minutes at a time, for one to three months, to begin to have an effect. Exercises are usually done to reduce urinary stress incontinence (especially after childbirth). Factors such as pregnancy, childbirth, aging, being overweight, and abdominal surgery such as cesarean section, often result in the weakening of the pelvic muscles. This can be assessed by either digital examination of vaginal pressure or using a Kegel perineometer.

The aim of Kegel exercises is to improve muscle tone by strengthening the pubococcygeus muscles of the pelvic floor. Kegel exercise is a popular prescribed exercise for pregnant women to prepare the pelvic floor for physiological stresses of the later stages of pregnancy and childbirth. Kegel exercises are said to be good for treating vaginal prolapse and preventing uterine prolapse in women. Kegel exercises may be beneficial in treating urinary incontinence and may also increase sexual gratification, allowing women to complete pompoir. The many actions performed by Kegel muscles include holding in urine and avoiding defecation. Reproducing this type of muscle action can strengthen the Kegel muscles. It is now known that the components of levator ani (the pelvic diaphragm), namely pubococcygeus, puborectalis and ileococcygeus, contract and relax as one muscle. Hence, pelvic floor exercises involve the entire levator ani rather than just the pubococcygeus alone. Pelvic floor exercises may be of benefit in cases of fecal incontinence and pelvic organ prolapse conditions, e.g., rectal prolapse.

Unfortunately, the effectiveness of conventional Kegel exercise programs has been shown to be limited. In particular, lack of a resistance force to flex against, lack of feedback, poor training, lack of patient confidence, lack of timely results, and poor compliance with the exercise recommendations undermine the effectiveness of conventional Kegel exercise programs. Thus, what is needed are improved systems, apparatus and methods for developing pelvic floor muscles.

SUMMARY

In some embodiments, the present invention provides a system for pelvic floor exercising. The system includes an anchor adapted for insertion into a user's body; a cord coupled to the anchor and adapted to extend external to the user's body when the anchor is inserted internal to the user's body; and a weight system adapted to be removably coupled to the cord.

In some other embodiments, the present invention provides an apparatus for pelvic floor exercising. The apparatus includes an anchor adapted for insertion into a user's body; and a flexible cord coupled to the anchor and adapted to extend external to the user's body when the anchor is inserted internal to the user's body and further adapted to coupled to a weight.

In yet other embodiments, the present invention provides a method of performing pelvic floor exercises. The method includes inserting an anchor internally to a user's body with an attached cord extending external to the user's body; attaching weight to the cord; and allowing the weight to hang freely while holding the anchor using pelvic muscles of the user.

Still other features, aspects, and advantages of the present invention will become more fully apparent from the following detailed description, the appended claims, and the accompanying drawings by illustrating a number of exemplary embodiments and implementations, including the best mode contemplated for carrying out the present invention. Embodiments of the present invention may also be capable of other and different applications, and its several details may be modified in various respects, all without departing from the spirit and scope of the present invention. Accordingly, the drawings and descriptions are to be regarded as illustrative in nature, and not as restrictive. The drawings are not necessarily drawn to scale. The description is intended to cover all modifications, equivalents, and alternatives falling within the spirit and scope of the claims.

DETAILED DESCRIPTION

Figure 1A:
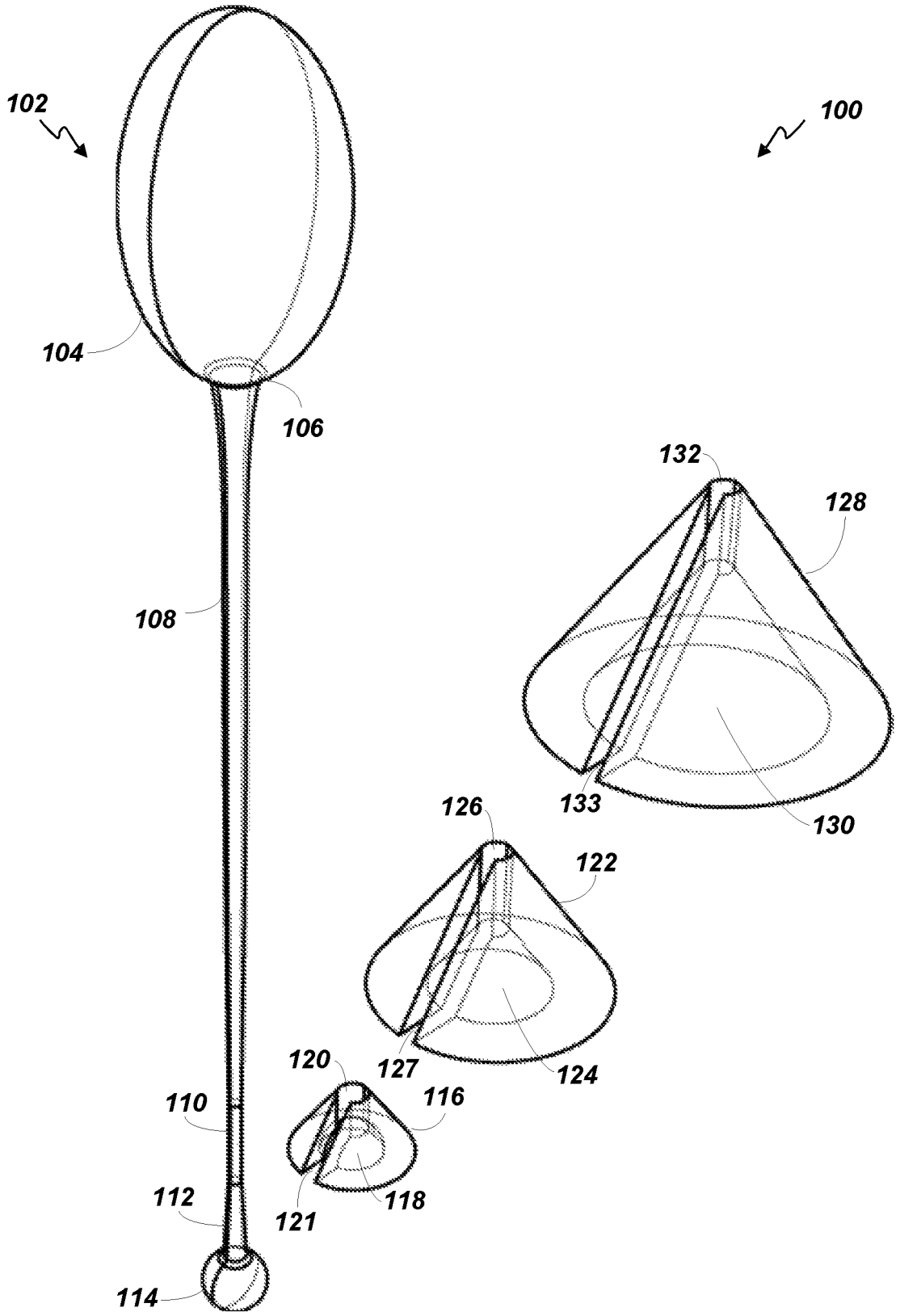
FIG. 1A is an isometric diagram depicting an example pelvic floor muscle development system according to embodiments of the present invention.

Embodiments of the present invention provide systems, apparatus, and methods for a pelvic floor muscle development system utilizing weight resistance with selectable modular weights disposed external to the body. An internal anchor component is held by the user with the pelvic muscles and a cord or flexible line extending from the anchor component external to the user's body is adapted to support one or more modular weights. Embodiments of the invention allow for accelerated development of strength of pelvic floor muscles over conventional systems by virtue of accommodating potentially unlimited addition of weight/pounds of pressure in a hygienic manner. In alternative embodiments, the modular weights are selectable in several different combinations to allow many options for the quantity of weight used. In some embodiments, the modular weights are stackable on the cord or flexible line extending from the anchor component. In other embodiments, the modular weights nest inside of each other similar to a matryoshka doll or "Russian nesting doll". In yet other embodiments, a bottle filled with liquid or particles (e.g., sand, gravel, pellets, etc.) with a bottle cap adapter configured to be attachable to the cord or flexible line can be used in place of the modular weights.

For improving pelvic floor and vaginal muscle tone, bulk, and strength, conventional commercially available pelvic floor development systems are limited to only a few types: isometric exercise with spherically shaped devices, isometric exercise with biofeedback from a pneumatic device or other pressure sensor that indicates relative pressure, electrodes that stimulate the pelvic floor muscle involuntarily to contract, and discrete vaginal weights held entirely or substantially intravaginally (i.e., internally). All of the conventional device types have inherent to their form and function an artificially low ceiling on the degree and rate of muscle tone, bulk and strength that can be achieved with their use. "Kegel" exercise balls, biofeedback devices that work with a software training program that tracks progress, and electrodes are all commercially available but do not provide sufficient and graduated resistance to allow muscle development beyond a relatively low threshold and at a relatively slow rate.

There are conventional weight training systems that use intravaginal (i.e., internal) weights. These systems are not designed to drop out of the user's body once the user reaches muscular failure, nor are they suitable for or capable of being used for dynamic exercises. Further, having the weight entirely inserted inside the body limits the amount of weight that can be used due to the limited volume of the vagina. For example, even using a relatively dense material used for an intravaginal weight, the practical upper limit for an average size vagina is in the range of approximately 80 grams to approximately 180 grams. To go beyond this range using commercially practicable materials would require a volume that would quickly exceed a size that is reasonably comfortable for vaginal insertion. Significantly, this weight range simply does not allow an advanced or healthy user to progress in pelvic floor muscle development beyond a relatively limited threshold. Further, these systems do not provide means to gradually increase the weight used beyond the practical upper weight limit of what fits inside the vagina. Embodiments of the present invention overcome these problems.

There are a number of reasons why an individual with a healthy pelvic floor would want to develop advanced muscle strength. For example, increased pelvic floor muscle strength improves orgasm intensity, length, and variation as well as the individual's ability to provide increased sensation to male partners. Further, the stronger the pelvic floor muscles are, the more an individual can delay the onset of pelvic floor weakness that is generally thought to accompany the aging process. In general, it is not widely known that it is possible to delay the onset of pelvic floor problems by a consistent strengthening program and women are not typically provided with guidance or tools for advanced development of the pelvic floor. Therefore, there is an upper-limit artificially placed on a person's capacity for health and sexual efficacy in this context using conventional tools and methods.

Embodiments of the present invention allow for potentially unlimited progression by not limiting the amount of weight the pelvic/vaginal muscles can attempt to hold. This is achieved by carrying the weight externally, thereby allowing for potentially infinite increases of weight to be added and thus avoiding the limits of intravaginal weight systems. With the increase of weight, and the resistance to pounds of pressure, there is more range for the development of muscle tone, bulk, and strength than is possible using any of the conventional systems mentioned above. Further, in some embodiments, the flexible line supporting the weights allows for dynamic exercise variations wherein the user can further develop muscles by swinging the suspended weights. Embodiments also allow users to exercise up to muscular failure in that the design accommodates allowing the intravaginal anchor component to fall out of the user without damaging the system. Embodiments of the present invention also allow for variations in the shape and size of the intravaginal anchor component without regard to weight so that a more comfortable, more stimulating, and/or challenging (e.g., harder to hold) shape can be employed.

Figure 1B:
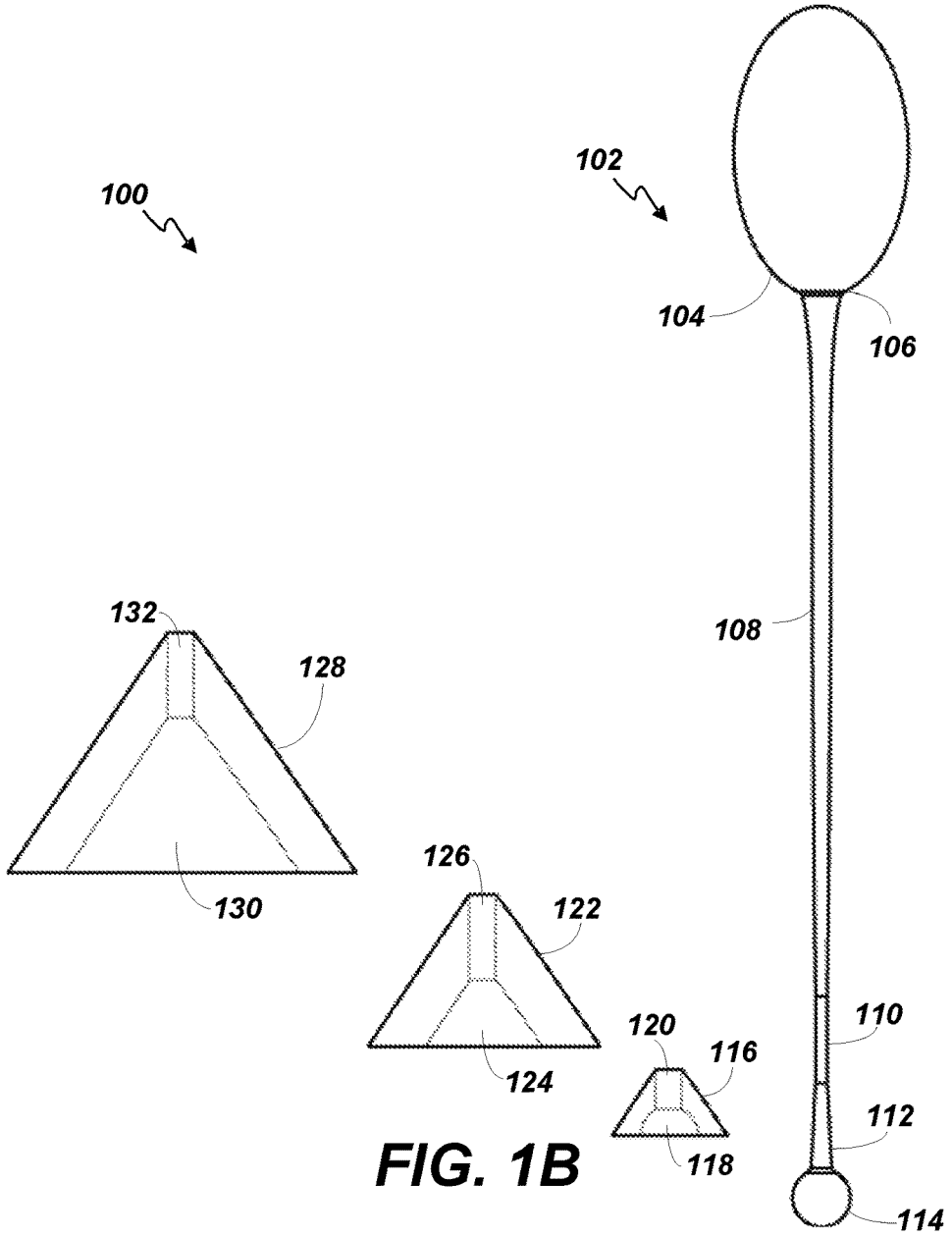
FIG. 1B is a font view of the example pelvic floor muscle development system of FIG. 1A.
Figure 1C:
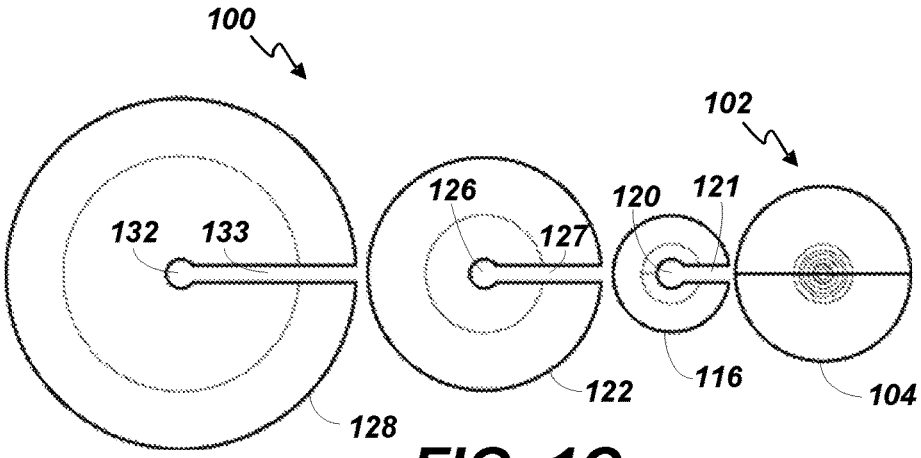
FIG. 1C is a top view of the example pelvic floor muscle development system of FIG. 1A.

Turning now to FIGS. 1A through 1C, isometric, front plan, and top views respectively of an example pelvic floor muscle development system 100 according to embodiments of the present invention are depicted. The system 100 includes an anchor assembly 102 which includes an anchor 104, upper linkage 106 that couples the anchor 104 to a flexible cord 108. The flexible cord 108 is coupled via lower linkage 110 to weight support 112 which is fastened to a base 114. The example system 100 further includes a first modular weight 116 which includes internal cavity 118, through-hole 120 and slot 121; a second modular weight 122 which includes internal cavity 124, through-hole 126 and slot 127; and a third modular weight 128 which includes internal cavity 130, through-hole 132 and slot 133. Note that the modular weights 116, 122, 128 are each of different sizes (and weight) and are adapted to "nest" within each other. In some non-nesting embodiments, the weights can merely stack on each other up the cord 108. The weights 116, 122, 128 mount securely on the anchor assembly 102 with the flexible cord 108 extending through the through-holes 120, 126, 132. The slots 121, 127, 133 allow the weights 116, 122, 128 to be threaded onto the cord 108 and the internal cavities 118, 124, 130 allow the weights 116, 122, 128 to nest within each other with the lightest weight 116 enclosing the base 114. In some embodiments, the weights 116, 122, 128 (and weight support 112 or base 114) can include a stud or tab that is adapted to extend into a recess or slot of another weight to better secure the weights together.

As will be described below in more detail with respect to FIGS. 2 through 5, the various modular weights 116, 122, 128 are adapted to be used in any combination to allow the user to select any desired weight to use for exercise. Further, the user can change the weights while exercising. This allows the user to work until muscular "failure" (i.e., the user cannot hold the weight any longer) and then instead of stopping, the user can simply reduce the weight and continue with the lighter amount of weight. In some embodiments, the weights can simply stack on top of each other without necessarily nesting within each other. Other shapes besides the nesting cone shapes shown can be used for the weights. For example, nesting spheres or nesting egg shapes can be used as well as, for example, stacking spheres or stacking plates.

Although only three modular weights 116, 122, 128 are shown, any practicable number of additional or fewer weights can be included in the system 100. For example, in some embodiments, five weights can be provided, each weight being e.g., 50% heavier. In this example, the lightest weight might be 40 grams, the next 60 grams, the next 90 grams, the next 135 grams, and the last 202.5 grams. Such a system of weights would allow a user to exercise with 40 grams, 60 grams, 90 grams, 100 grams (e.g., using the 40 gram and 60 grams weights), 130 grams (e.g., using the 40 gram and the 90 gram weights), 135 grams, 150 grams, 175 grams, 202.5 grams, 242.5 grams, 262.5 grams, etc. all the way up to 527.2 grams. The weights can thus be used in any desired combination to achieve a desired weight over a broad range of weights.

In some embodiments, the weights can range from 30 grams to 300 grams in 30 gram increments. Other weights and increments are possible. The diameter of the anchor can range from approximately 1.5 cm to approximately 5 cm. Other diameters are possible. The length of the anchor can range from approximately 2 cm to approximately 12 cm. Other lengths are possible. The cord can vary in length from approximately 5 cm to approximately 30 cm. Other lengths are possible. In some embodiments, the cord can be elastic or non-stretchable. In some embodiments, the anchor can have a smooth surface with a relatively low coefficient of friction. In some embodiments, the anchor can be coated with a lubricant. In some embodiments, the surface of the anchor can be textured, ribbed, or include grooves. In some embodiments, the anchor can be highly compressible or incompressible. In some embodiments the anchor can be solid or hollow. In some embodiments, the anchor can be filled with a solid, liquid or gas. In some embodiments, the anchor can include a battery-powered heating and/or vibrating element.

In some embodiments, the upper linkage 106 and the lower linkage 110 allow the components to be detached from each other to facilitate replacement. For example, in some embodiments, the anchor 104 can be provided in several alternative shapes (e.g., egg shaped, peanut shaped, elongated shaped, tear drop shaped, spherical, spheroid, cylindrical, conical, etc.), sizes (e.g., small, medium, large, etc.), densities (e.g., incompressible, highly compressible, ridged, etc.) and textures (e.g., smooth, rubbery coating, ribbed, bumpy, etc.). The system 100 can be configured to allow the user to replace the anchor 104 with an alternative size, shape, density, and texture anchor for different exercises or other uses. Likewise, the flexible cord 108 can be replaced by the user with cords of different flexibility, length, elasticity, etc. The upper linkage 106 and the lower linkage 110 can include any practicable fastening means including snap-fit, screw, clasp, catch, clip, etc. for attaching to the anchor 104, flexible cord 108, the weight support 112, and base 114. Note that in some embodiments, the weight support 112 is not used and the weights 116, 122, 128 are stacked on the base 114 alone.

Alternatively, in some embodiments, all or part of the anchor assembly 102 can be constructed as a single piece with each of the anchor 104, flexible cord 108, the weight support 112, and/or base 114 being integrally formed from a single piece of the same material. Such an embodiment provides a hygienic device that has no recesses or joints that can trap dirt, bacteria, or other particles.

Alternatively, in some embodiments, instead of, or in addition to, the modular weights 116, 122, 128, an adapter configured to couple to the base 114 can be provided to attach to other objects for use as a weight. For example, as illustrated in FIGS. 10 to 13, an adapter 1000 including female threading 1002 suitable for attaching to, for example, a standard water or two liter soda bottle (not shown) can be used. The adapter 1000 can include a key-hole type opening 1004 to receive the base 114 and securely engage it with the cord 108 extending up to the anchor 104 (not shown in FIGS. 10-13). The bottle can be filled with, for example, sand, gravel, water, or other material to provide an infinitely selectable amount of weight. The adapter 1000 can also include ridges 1006 (or grooves) to more easily facilitate gripping the adapter 1000 when attaching it to a bottle.

The system 100 is simple to use because the weights attach without requiring use of tools, likewise simple to take apart, and surfaces are smooth and with few joints facilitating cleaning of the device. The weights 116, 122, 128 can be made from metal (e.g., iron, steel, etc.) or any practicable dense material. The weights can be bare metal, covered with plastic, rubber, or other coating, they can be anodized, and/or coated for aesthetic reasons as this part of the system 100 is not used internal to the body. The weights 116, 122, 128 can be labeled to indicate the amount of weight of each. The anchor assembly 102 including the anchor 104 and cord 108 can be made of any body-safe material such as non-porous silicone, rubber and synthetic rubbers.

In alternative embodiments, the flexible cord 108 can be connected to other devices capable of providing pounds of weight for resistance. For example, the cord can hook onto, or otherwise attach to, an elastic band that the user stands on while doing squat exercises. With the anchor held intravaginal, the cord is pulled downwardly as the user stands up and the pressure is released as the user squats down. In other embodiments, an elastic band, a partner, or a machine (e.g., an oscillating armature with a linkage flexibly attached to the cord) can be used to generate the pulling force that the user strives to counter by holding the anchor.

In some embodiments, the anchor 104 can be injection molded, casted, 3D printed, or milled plastic, silicone, ceramics, or metal using a body-safe material. The cord 108 can be injection molded, casted, 3D printed, or milled plastic, silicone, ceramics, or metal using a body-safe material. The anchor assembly 102 is adapted to be smooth and formed without crevasses from a non-porous body-safe material for hygienic and safety purposes (e.g., not to trap dirt, bacteria, and other particles). The weights 116, 122, 128 can be injection molded, casted, 3D printed, or milled plastic, silicone, ceramics, or metal in any practicable material since it is used external to the user's body. The weights 116, 122, 128 are configured to allow increasing weight to be added in discrete increments during exercise. The entire system 100 is impact resistant, since it will drop out of the body during proper use.

The anchor 104 may be connected to the cord 108 in a variety of ways. The anchor 104 may be whole (e.g., integrally formed) with the cord 108 and the first weight 116. In some embodiments, the anchor 104 may be whole with the cord 108 and separately attachable to the weights 116, 122, 128. In some embodiments, the anchor 104 may be attached to the cord 108 and in turn to the weights 116, 122, 128. The weights 116, 122, 128 can be powder-coated or otherwise sheathed in a soft and colored material.

In some embodiments, the anchor 104 can be adapted to include an internal vibrator, noise generator, signal transmitter, pressure transducer, microprocessor, and/or heater (e.g., using an inbuilt inductively rechargeable battery-powered motor, chime, wireless signal transceiver, sensors, processor, or other device) to give biofeedback signals to the user (or user device, e.g., smartphone) in response to usage.

Figure 2:
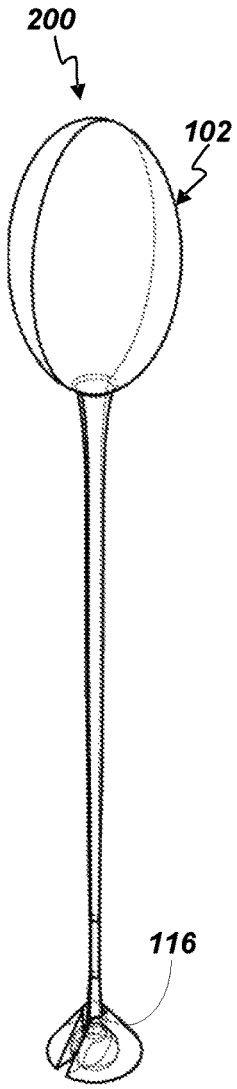
FIG. 2 is an isometric diagram depicting a first example configuration of the example pelvic floor muscle development system according to embodiments of the present invention.
Figure 3:
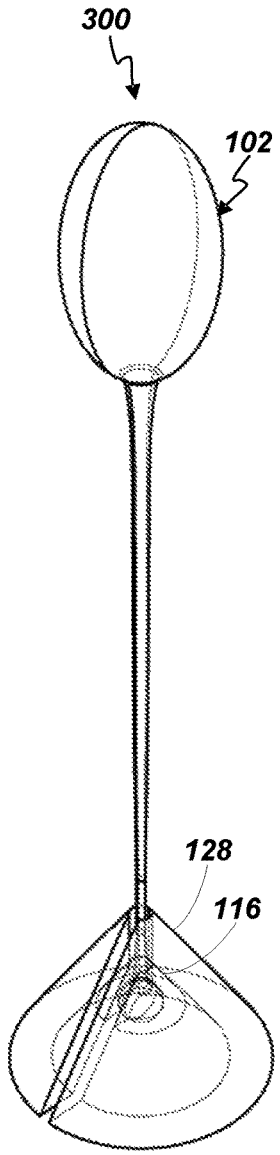
FIG. 3 is an isometric diagram depicting a second example configuration of the example pelvic floor muscle development system according to embodiments of the present invention.
Figure 4:
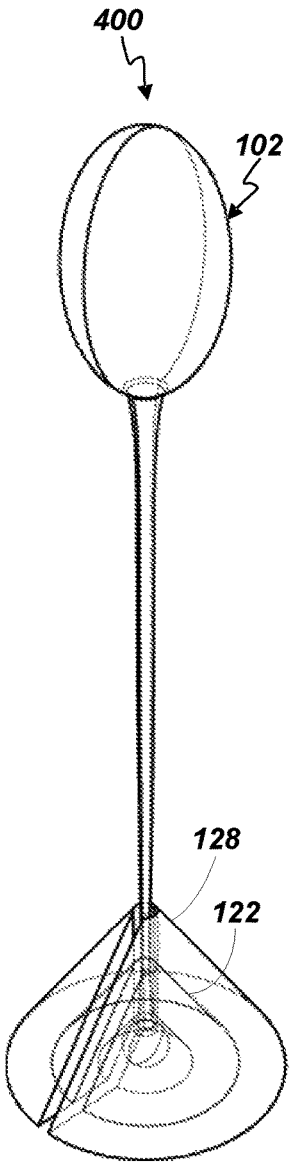
FIG. 4 is an isometric diagram depicting a third example configuration of the example pelvic floor muscle development system according to embodiments of the present invention.
Figure 5:
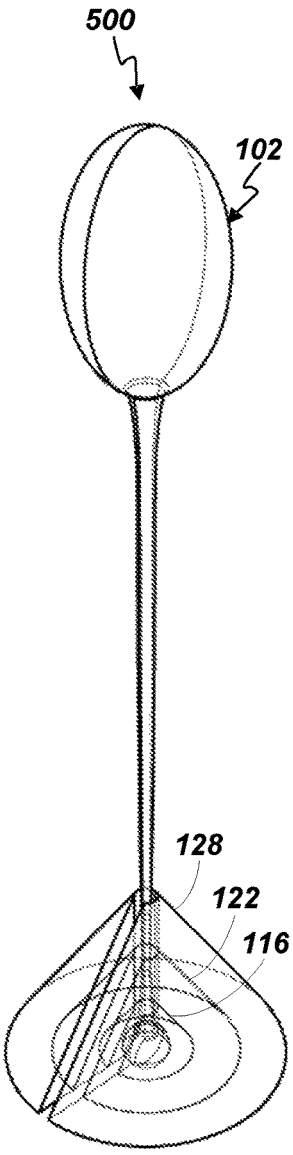
FIG. 5 is an isometric diagram depicting a fourth example configuration of the example pelvic floor muscle development system according to embodiments of the present invention.

Turning now to FIGS. 2 through 5, four example weight combination configurations are illustrated. In FIG. 2, only the lightest modular weight 116 is mounted on the anchor assembly 102 to illustrate a first configuration 200. In FIG. 3, the lightest modular weight 116 and the heaviest modular weight 128 are mounted on the anchor assembly 102 to illustrate a second configuration 300. In FIG. 4, the heaviest modular weight 128 and the next heaviest modular weight 122 are mounted on the anchor assembly 102 to illustrate a third configuration 400. In FIG. 5, the lightest modular weight 116, the heaviest modular weight 128 and the next heaviest modular weight 122 are mounted on the anchor assembly 102 to illustrate a fourth configuration 500. Other configurations not shown are possible.

Figure 6:
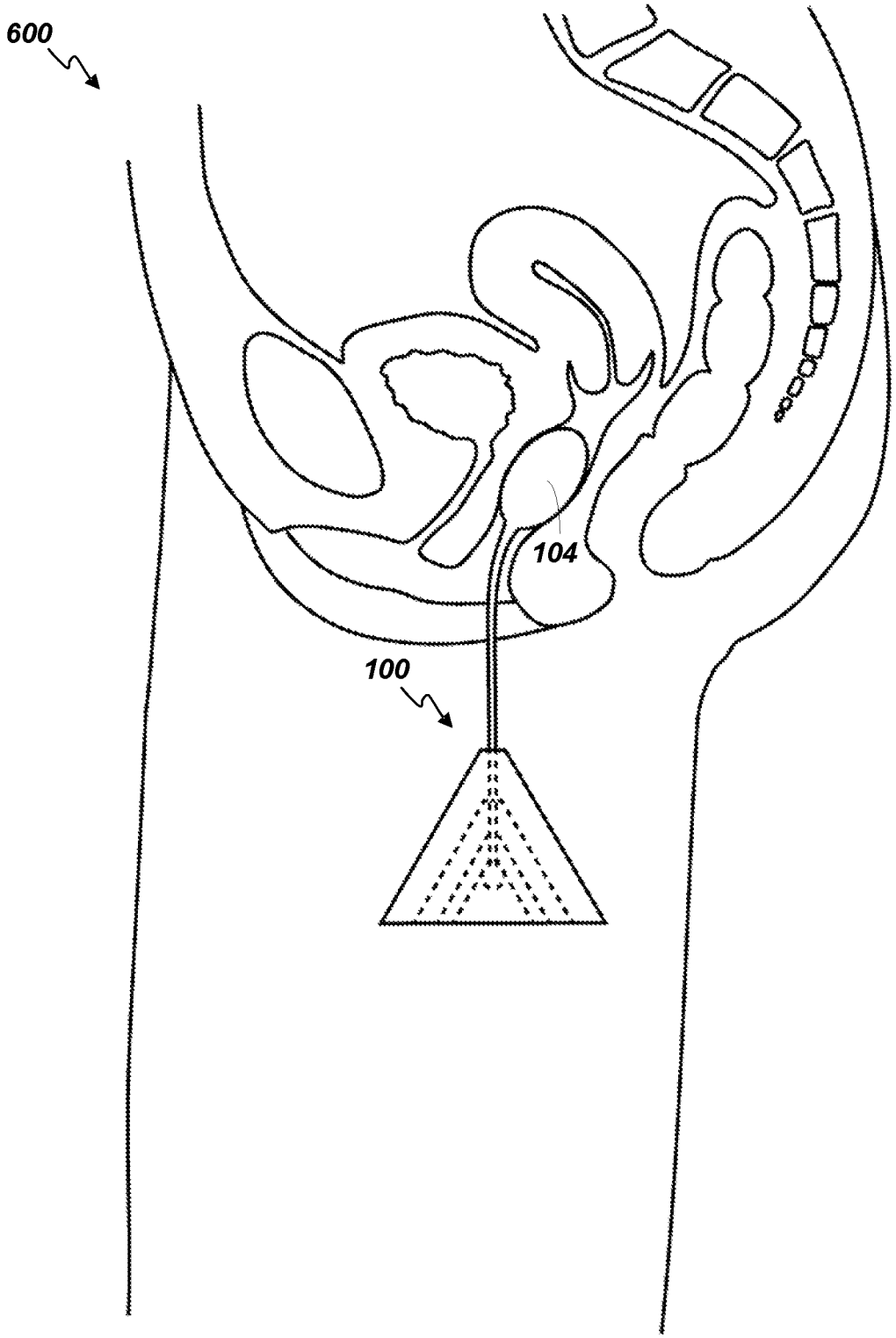
FIG. 6 is a cross-sectional view of the example pelvic floor muscle development system of FIG. 1 in use according to embodiments of the present invention.
Figure 7:
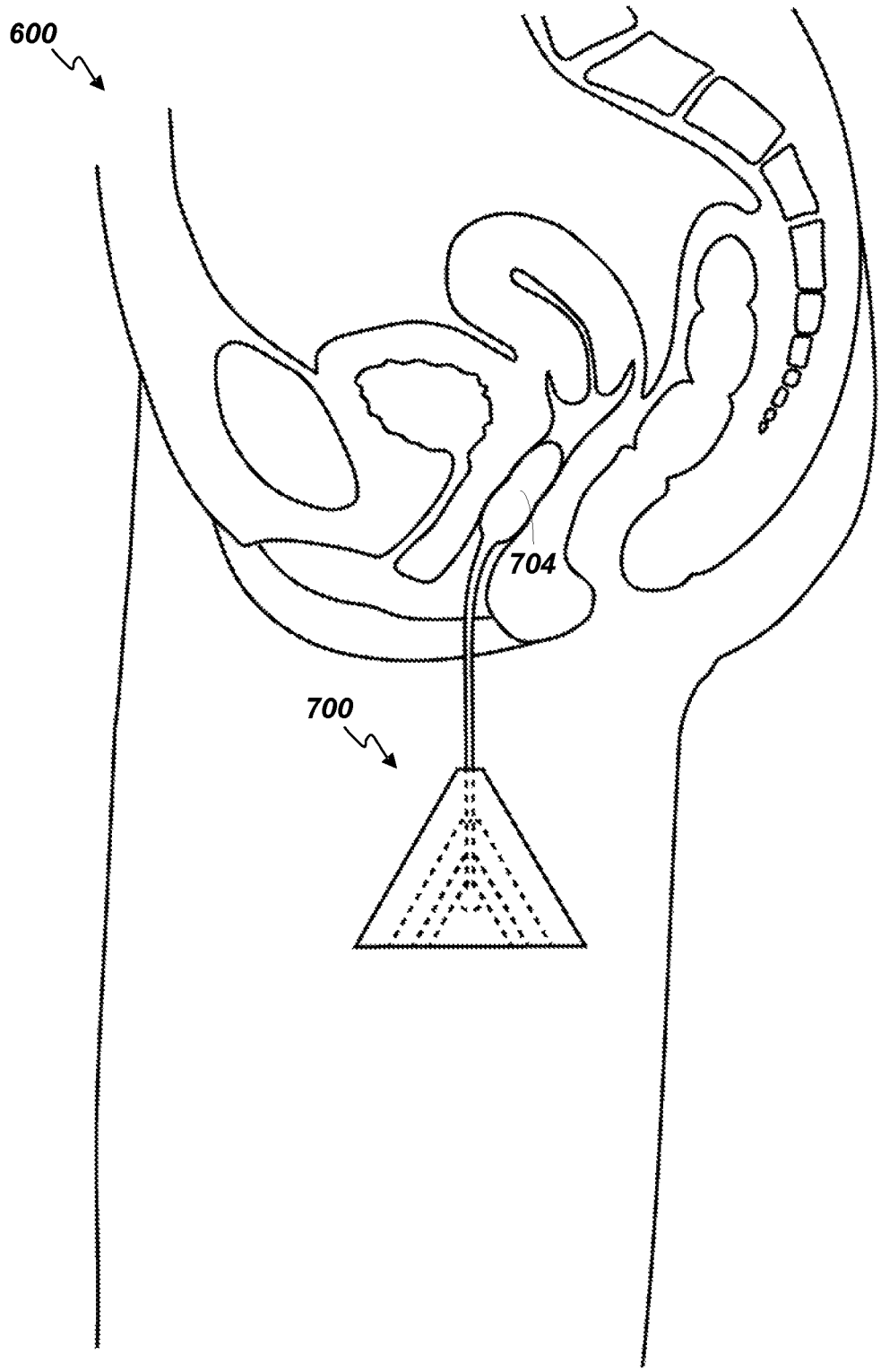
FIG. 7 is a cross-sectional view of a first alternative embodiment of a pelvic floor muscle development system in use according to embodiments of the present invention.
Figure 8:
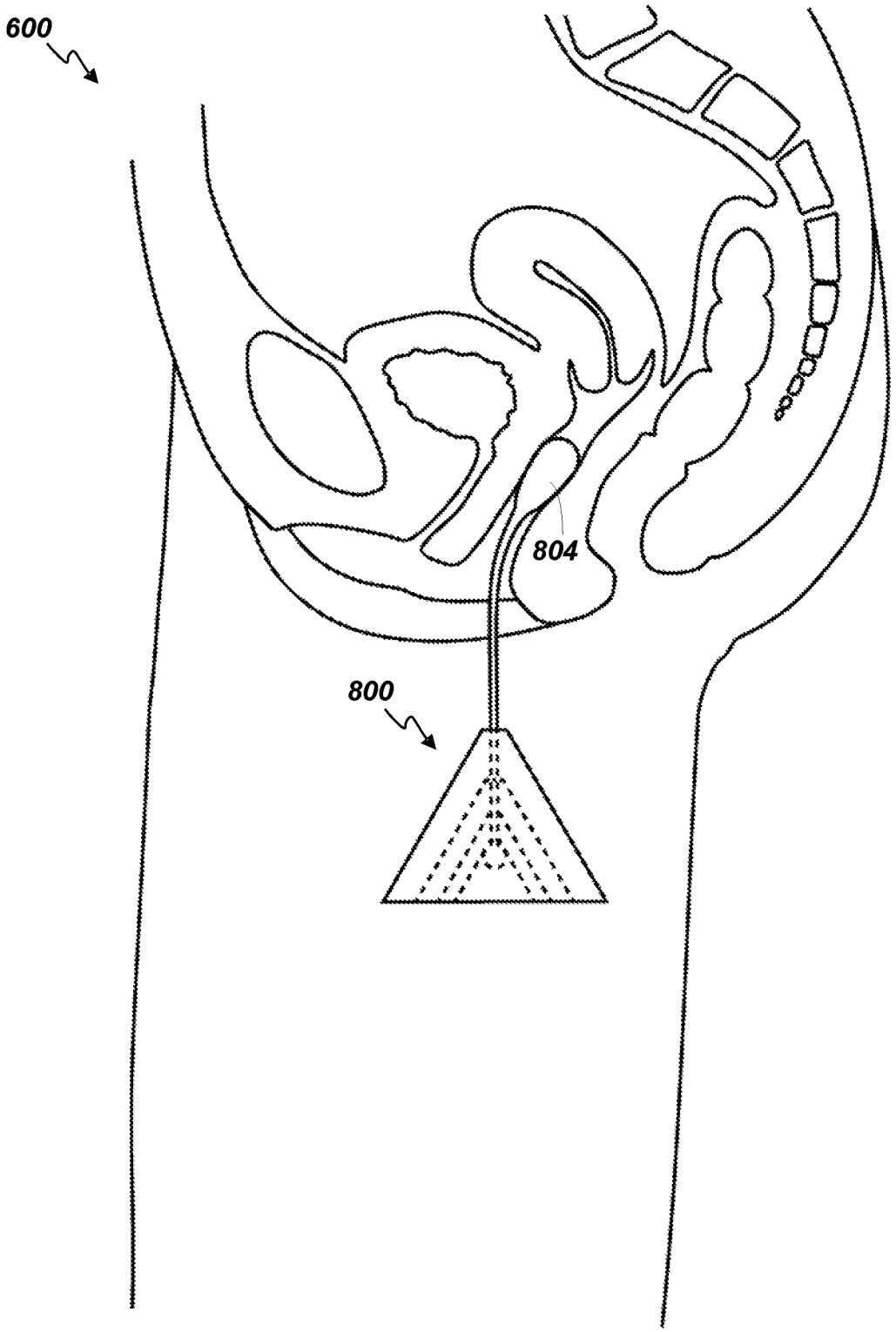
FIG. 8 is a cross-sectional view of a second alternative embodiment of a pelvic floor muscle development system in use according to embodiments of the present invention.

FIGS. 6 through 8 provide cross-sectional views that illustrate the intravaginal positioning of the system during use with three alternative anchor shapes. FIG. 6 depicts a cross-section of a female pelvis area 600 with the anchor 104 of the example system 100 of FIG. 1A inserted vaginally. FIG. 7 depicts a cross-section of a female pelvis area 600 with a first alternative example system 700 that includes a peanut-shaped anchor 704 inserted vaginally. FIG. 8 depicts a cross-section of a female pelvis area 600 with a second alternative example system 800 that includes a teardrop-shaped anchor 804 inserted vaginally. Many alternative shaped anchors are possible as well as many alternative shaped weights.

Figure 9:
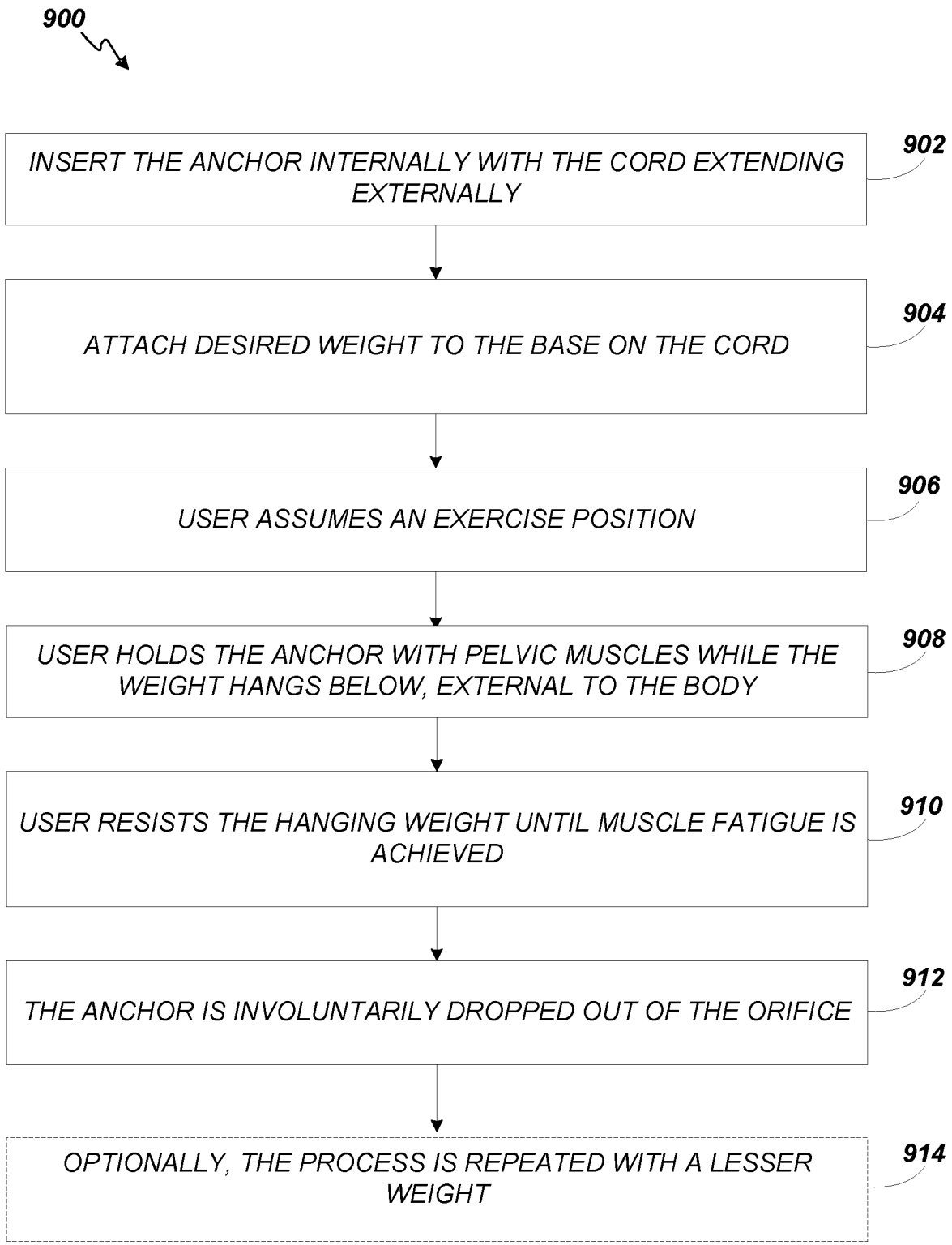
FIG. 9 is a flowchart illustrating an example method of using a pelvic floor muscle development system according to embodiments of the present invention.
Figure 10:
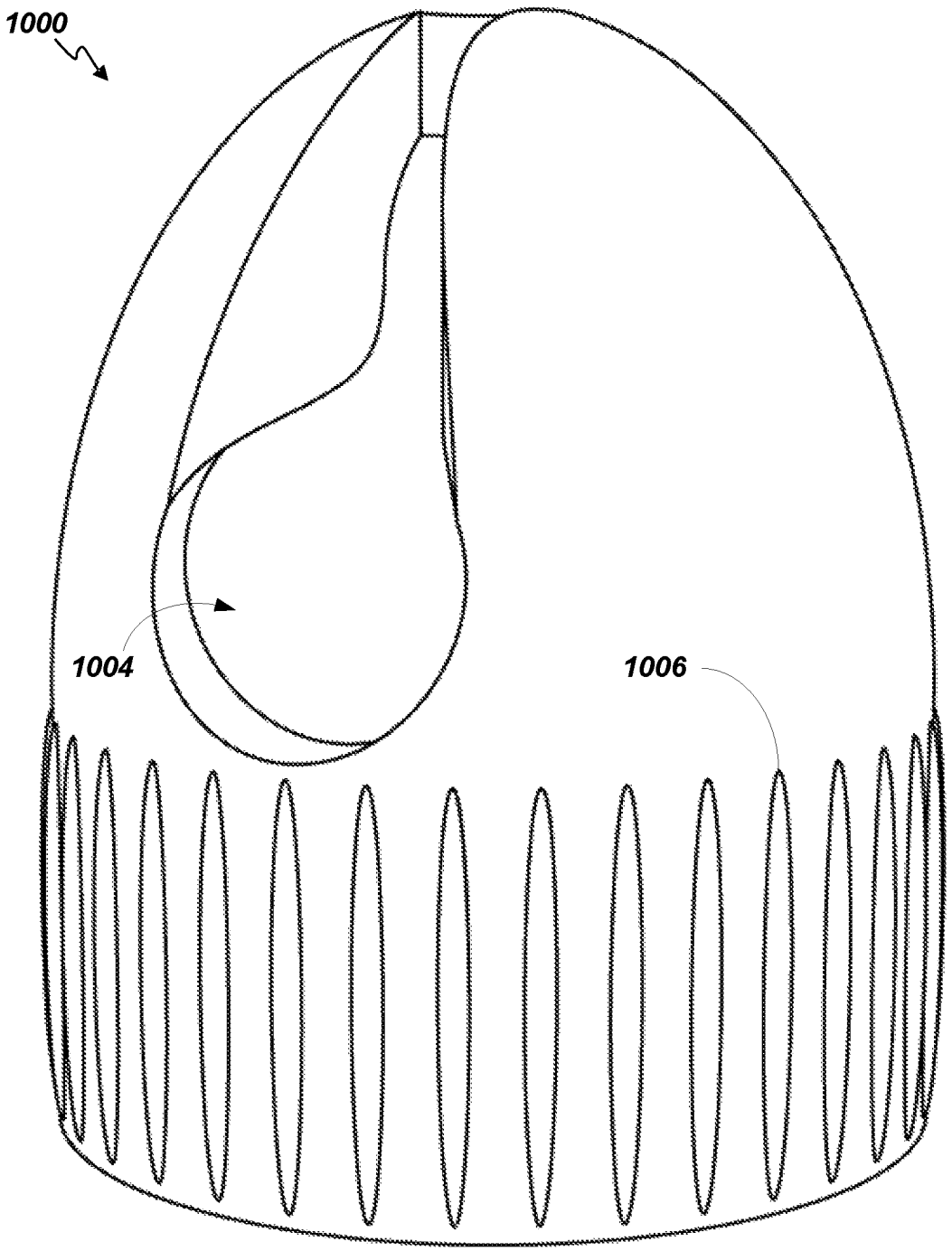
FIG. 10 is an isometric diagram depicting an alternative weight system for use with the example pelvic floor muscle development system according to embodiments of the present invention.
Figure 11:
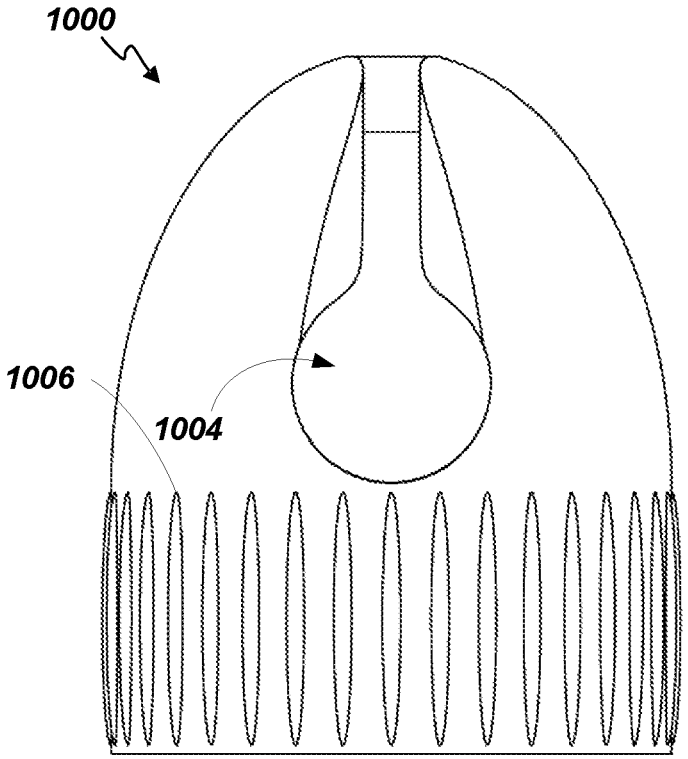
FIG. 11 is a front view of the alternative weight system of FIG. 10.
Figure 12:
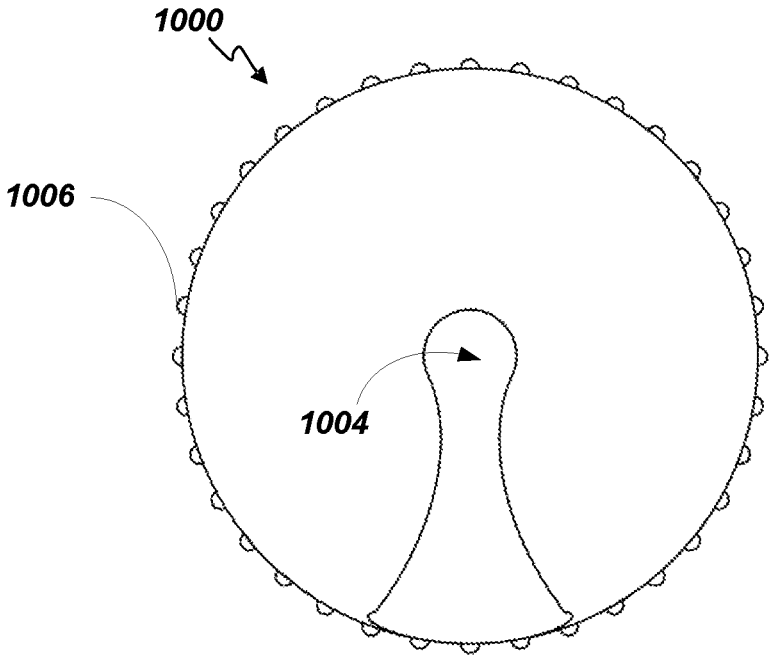
FIG. 12 is a top view of the alternative weight system of FIG. 10.
Figure 13:
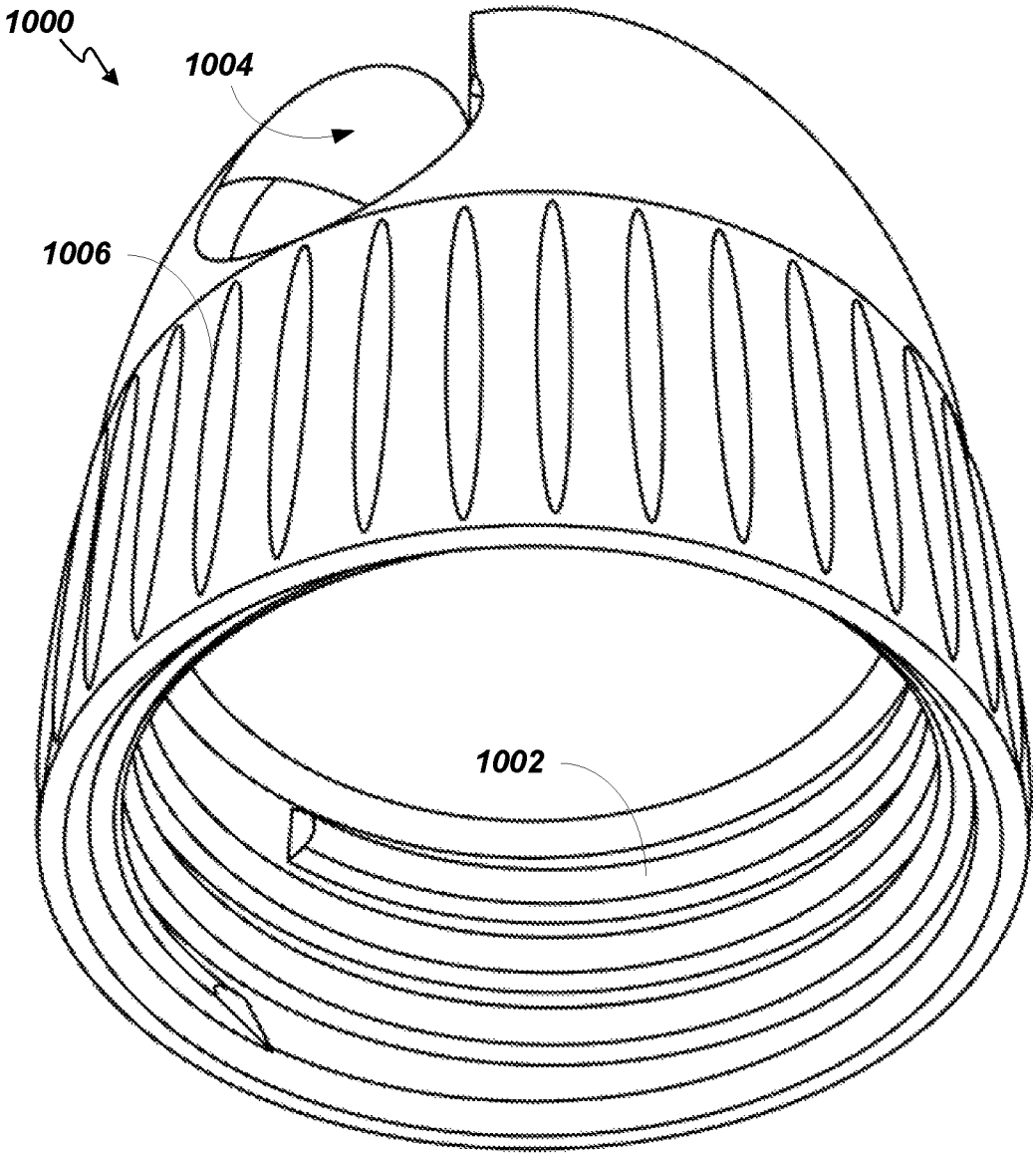
FIG. 13 is an isometric bottom view of the alternative weight system of FIG. 10.

Turning now to FIG. 9, an example method 900 of using the system 100 is illustrated. In use, the anchor is inserted internally (e.g., intravaginally) by pushing the smooth rounded anchor into the orifice such that the cord extends outside the body (902). The weights are attached to the cord allowing for the weight system to be suspended external to the body (904). The user assumes an exercise position such as laying, standing, squatting, or kneeling (906) with the anchor held internally and the weight hanging free externally (908). Thereby, the user resists the force created by the external weight until muscle fatigue is established (910). Once muscle fatigue is reached, the system is involuntarily dropped and allowed to fall out of the orifice (912). Optionally, the process can be repeated as part of an exercise protocol (914). In some embodiments, the process is repeated with decreasing weight. In other embodiments, increasing weight may be used for the repetitions.

Alternative uses would allow the user, depending on the starting strength of the muscles, to use the system in a progressive manner, allowing for safe and systematic improvement over time, which is the intended purpose of the system. The user could begin using the invention by laying down and holding the anchor inside. The user practices expelling the anchor using only the pelvic floor muscles. This action is repeated with the anchor until strength improves by following an exercise protocol of repetitions over many days. Then the user can progress to holding the anchor inside whilst standing or kneeling until the anchor falls out of the body, or the subject pushes it out using the pelvic floor muscles. This is repeated until strength improves following an exercise protocol of repetitions over many days. Next the user progresses to gently pulling on the cord to increase resistance training following an exercise protocol of repetitions over many days and pulling over time with increased resistance thereby creating pounds of pulling force for the muscles to work against. Once the user is sufficiently strong, the user then adds weight by attaching modular weights to the cord externally and holds in the anchor internally following an exercise protocol of repetitions over many days. The user adds weight progressively over time in response to advanced development of muscle strength.

In some embodiments, the system can be used to improve muscle strength in the muscles of the rectum. By inserting the anchor device into the rectum and following the protocol described above, the rectal muscles can be developed. In some embodiments, the system can be used in a more dynamic manner than described above. For example, the user can attempt to resist the pulling force generated while gently swinging the weights between the legs like a pendulum. In some embodiments, the system can be used for sexual pleasure.

The following example exercise regimen can be used in some embodiments:

- Woman stands with legs apart
- She inserts the internal anchor into the vagina
- She contracts muscles to hold it in
- The weight system is outside the body and gravity provides force to resist against
- The woman holds as much weight as she can for 10 seconds, then she rests for 20 seconds
- She does as many sets as she can in 5 minutes three times a week After the first week holding the weight for ten seconds, which was the original baseline for the point of exhaustion, she tries to hold the weight as long as possible. Counting how long it is held, and then releasing for double the time.

In another example, the user exercises by holding the weight in until she automatically releases due to muscle exhaustion, then relaxes for twice the amount of time and repeats for five minutes three times a week. Once she can hold it in for a minute at a time she can choose to increase weight or hold it in longer. Once she can hold it in for five minutes, she should consider increasing weight up a step.

Figure 14:
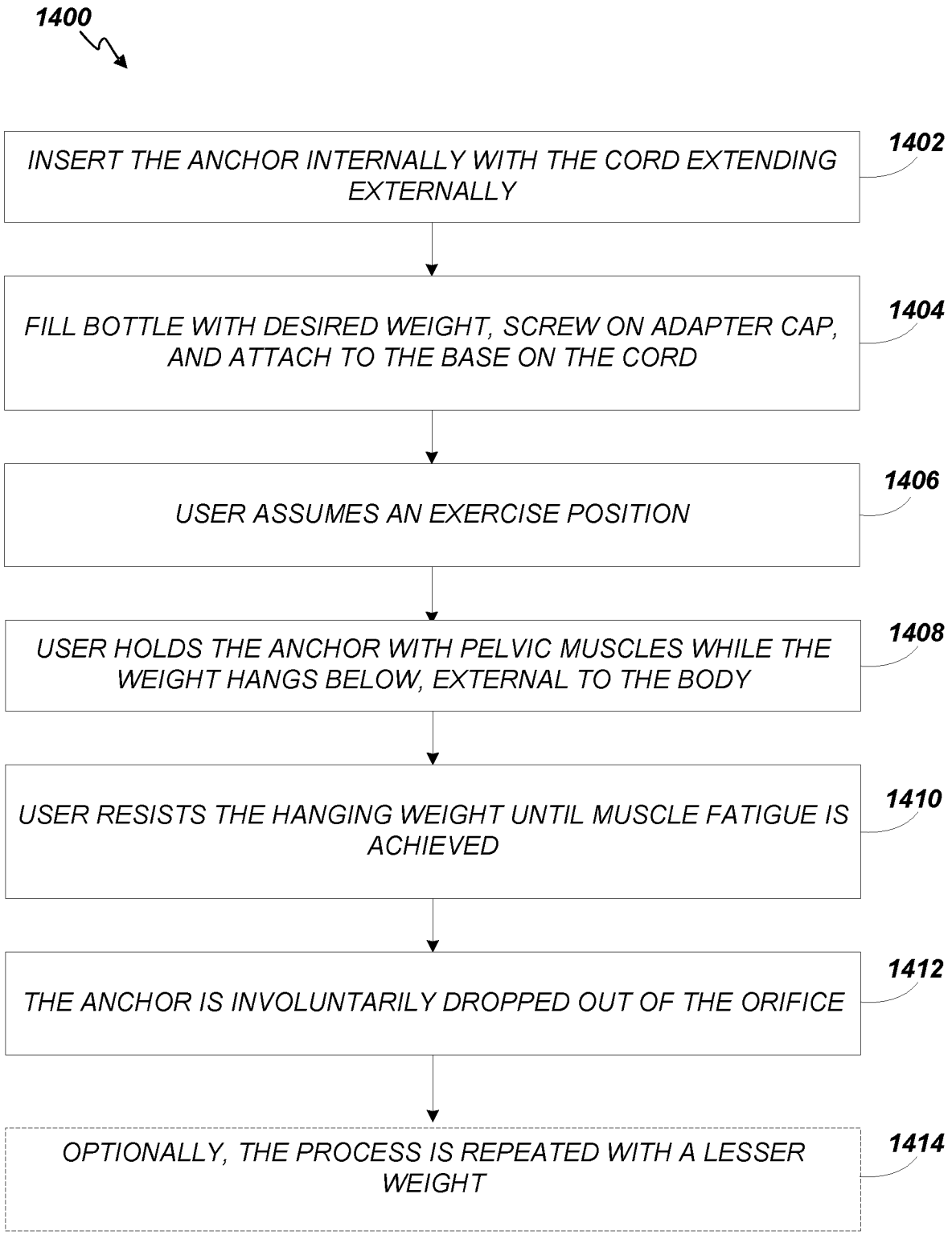
FIG. 14 is a flowchart illustrating another example method of using a pelvic floor muscle development system according to embodiments of the present invention.

Turning now to FIG. 14, an alternative example method 1400 of using the system 100 with the adapter 1000 and a bottle is illustrated. In use, the anchor is inserted internally (e.g., intravaginally) by pushing the smooth rounded anchor into the orifice such that the cord extends outside the body (1402). The bottle is filled with a liquid or other material to a desired weight, the adapter cap is attached to the bottle, and the adapter cap is attached to the cord allowing for the bottle to be suspended external to the body (1404). The user assumes an exercise position such as laying, standing, squatting, or kneeling (1406) with the anchor held internally and the weight hanging free externally (1408). Thereby, the user resists the force created by the external weight until muscle fatigue is established (1410). Once muscle fatigue is reached, the system is involuntarily dropped and allowed to fall out of the orifice (1412). Optionally, the process can be repeated as part of an exercise protocol (1414). In some embodiments, the process is repeated with decreasing weight in the bottle. In other embodiments, increasing weight in the bottle may be used for the repetitions.

The following example exercise regimen can be used in some embodiments:

- Woman stands with legs apart
- She inserts the internal anchor into the vagina
- She contracts muscles to hold in the anchor
- The weight system is outside the body and gravity provides force to resist against
- The woman attaches a water bottle filled with an amount water she can hold for a count of ten using the adapter
- The woman holds the weight for 10 seconds, then she rests for 20 seconds
- She does as many sets as she can in 5 minutes three times a week After the first week holding the weight for ten seconds, which was the original baseline for the point of exhaustion, she tries to hold the weight as long as possible. Counting how long it is held, and then releasing for double the time. She exercises by holding it in until she automatically releases due to muscle exhaustion, then relaxes for twice the amount of time and repeats for five minutes three times a week. Once she can hold the weight for a minute at a time she can choose to increase weight or hold it in longer. Once she can hold the weight for five minutes, she should consider increasing weight by adding more water to the bottle in one ounce increments.

Over time, the following example exercise regimen can be used in some embodiments:

- Week 1: count to ten holding the weight, count to twenty while resting, repeat for five minutes three times a week
- Week 2: count to 15 holding the weight, count to thirty while resting, repeat for five minutes three times a week
- Week 3: count to 20 holding the weight, count to forty while resting, repeat for five minutes three times a week
- Week 4: count to 25 holding the weight, count to fifty while resting, repeat for five minutes three times a week She increases the weight up a step in the weight system at the end of four weeks. There is no cause for concern if the woman chooses to exercise longer or more often. She can experiment with increasing weight in accordance with her preference. The fact that the muscles automatically release at the point of exhaustion is an automatic safety mechanism and it is also an optimal form of exercise.

In addition to the baseline exercise, the user can reduce her normal amount of weight and place the internal anchor higher in the vaginal canal toward the cervix and practice accordingly. In some embodiments, the user can bend her knees while exercising and gently bounce up and down by flexing her knees which will activate the weights in a dynamic way, thereby challenging the muscles even more. In addition to the baseline exercise, the user can kneel, be on all fours, or move hips in a circle, or swing the weight gently. Variations will add to the complexity of the muscle movement for a more active workout.

Numerous embodiments are described in this disclosure, and are presented for illustrative purposes only. The described embodiments are not, and are not intended to be, limiting in any sense. The presently disclosed invention(s) are widely applicable to numerous embodiments, as is readily apparent from the disclosure. One of ordinary skill in the art will recognize that the disclosed invention(s) may be practiced with various modifications and alterations, such as structural, logical, software, and electrical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

The present disclosure is neither a literal description of all embodiments nor a listing of features of the invention that must be present in all embodiments.

The Title (set forth at the beginning of the first page of this disclosure) is not to be taken as limiting in any way as the scope of the disclosed invention(s).

The term "product" means any machine, manufacture and/or composition of matter as contemplated by 35 U.S.C. § 101, unless expressly specified otherwise.

The terms "an embodiment", "embodiment", "embodiments", "the embodiment", "the embodiments", "one or more embodiments", "some embodiments", "one embodiment" and the like mean "one or more (but not all) disclosed embodiments", unless expressly specified otherwise.

The terms "the invention" and "the present invention" and the like mean none or more embodiments of the present invention."

A reference to "another embodiment" in describing an embodiment does not imply that the referenced embodiment is mutually exclusive with another embodiment (e.g., an embodiment described before the referenced embodiment), unless expressly specified otherwise.

The terms "including", "comprising" and variations thereof mean "including but not limited to", unless expressly specified otherwise.

The terms "a", "an" and "the" mean "one or more", unless expressly specified otherwise.

The term "and/or", when such term is used to modify a list of things or possibilities (such as an enumerated list of possibilities) means that any combination of one or more of the things or possibilities is intended, such that while in some embodiments any single one of the things or possibilities may be sufficient in other embodiments two or more (or even each of) the things or possibilities in the list may be preferred, unless expressly specified otherwise. Thus for example, a list of "a, b and/or c" means that any of the following interpretations would be appropriate: (i) each of "a", "b" and "c"; (ii) "a" and "b"; (iii) "a" and "c"; (iv) "b" and "c"; (v) only "a"; (vi) only "b"; and (vii) only "c."

The term "plurality" means "two or more", unless expressly specified otherwise.

The term "herein" means "in the present disclosure, including anything which may be incorporated by reference", unless expressly specified otherwise.

The phrase "at least one of", when such phrase modifies a plurality of things (such as an enumerated list of things) means any combination of one or more of those things, unless expressly specified otherwise. For example, the phrase at least one of a widget, a car and a wheel means either (i) a widget, (ii) a car, (iii) a wheel, (iv) a widget and a car, (v) a widget and a wheel, (vi) a car and a wheel, or (vii) a widget, a car and a wheel.

The phrase "based on" does not mean "based only on", unless expressly specified otherwise. In other words, the phrase "based on" describes both "based only on" and "based at least on".

Each process (whether called a method, algorithm or otherwise) inherently includes one or more steps, and therefore all references to a "step" or "steps" of a process have an inherent antecedent basis in the mere recitation of the term 'process' or a like term. Accordingly, any reference in a claim to a 'step' or 'steps' of a process has sufficient antecedent basis.

When an ordinal number (such as "first", "second", "third" and so on) is used as an adjective before a term, that ordinal number is used (unless expressly specified otherwise) merely to indicate a particular feature, such as to distinguish that particular feature from another feature that is described by the same term or by a similar term. For example, a "first widget" may be so named merely to distinguish it from, e.g., a "second widget". Thus, the mere usage of the ordinal numbers "first" and "second" before the term "widget" does not indicate any other relationship between the two widgets, and likewise does not indicate any other characteristics of either or both widgets. For example, the mere usage of the ordinal numbers "first" and "second" before the term "widget" (1) does not indicate that either widget comes before or after any other in order or location; (2) does not indicate that either widget occurs or acts before or after any other in time; and (3) does not indicate that either widget ranks above or below any other, as in importance or quality. In addition, the mere usage of ordinal numbers does not define a numerical limit to the features identified with the ordinal numbers. For example, the mere usage of the ordinal numbers "first" and "second" before the term "widget" does not indicate that there must be no more than two widgets.

When a single device, component or article is described herein, more than one device, component or article (whether or not they cooperate) may alternatively be used in place of the single device, component or article that is described. Accordingly, the functionality that is described as being possessed by a device may alternatively be possessed by more than one device, component or article (whether or not they cooperate).

Similarly, where more than one device, component or article is described herein (whether or not they cooperate), a single device, component or article may alternatively be used in place of the more than one device, component or article that is described. For example, a plurality of computer-based devices may be substituted with a single computer-based device. Accordingly, the various functionality that is described as being possessed by more than one device, component or article may alternatively be possessed by a single device, component or article.

The functionality and/or the features of a single device that is described may be alternatively embodied by one or more other devices that are described but are not explicitly described as having such functionality and/or features. Thus, other embodiments need not include the described device itself, but rather can include the one or more other devices which would, in those other embodiments, have such functionality/features.

A description of an embodiment with several components or features does not imply that all or even any of such components and/or features are required. On the contrary, a variety of optional components are described to illustrate the wide variety of possible embodiments of the present invention(s). Unless otherwise specified explicitly, no component and/or feature is essential or required.

Further, although process steps, algorithms or the like may be described in a sequential order, such processes may be configured to work in different orders. In other words, any sequence or order of steps that may be explicitly described does not necessarily indicate a requirement that the steps be performed in that order. The steps of processes described herein may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention, and does not imply that the illustrated process is preferred.

Although a process may be described as including a plurality of steps, that does not indicate that all or even any of the steps are essential or required. Various other embodiments within the scope of the described invention(s) include other processes that omit some or all of the described steps. Unless otherwise specified explicitly, no step is essential or required.

Although a product may be described as including a plurality of components, aspects, qualities, characteristics and/or features, that does not indicate that all of the plurality are essential or required. Various other embodiments within the scope of the described invention(s) include other products that omit some or all of the described plurality.

An enumerated list of items (which may or may not be numbered) does not imply that any or all of the items are mutually exclusive, unless expressly specified otherwise. Likewise, an enumerated list of items (which may or may not be numbered) does not imply that any or all of the items are comprehensive of any category, unless expressly specified otherwise. For example, the enumerated list "a computer, a laptop, a PDA" does not imply that any or all of the three items of that list are mutually exclusive and does not imply that any or all of the three items of that list are comprehensive of any category.

Headings of sections provided in this disclosure are for convenience only, and are not to be taken as limiting the disclosure in any way.

The present disclosure provides, to one of ordinary skill in the art, an enabling description of several embodiments and/or inventions. Some of these embodiments and/or inventions may not be claimed in the present application, but may nevertheless be claimed in one or more continuing applications that claim the benefit of priority of the present application. Applicants intend to file additional applications to pursue patents for subject matter that has been disclosed and enabled but not claimed in the present application.

The foregoing description discloses only example embodiments of the invention. Modifications of the above-disclosed apparatus, systems and methods which fall within the scope of the invention will be readily apparent to those of ordinary skill in the art.

Accordingly, while the present invention has been disclosed in connection with exemplary embodiments thereof, it should be understood that other embodiments may fall within the spirit and scope of the invention, as defined by the following claims.

The invention claimed is:

1. A system for pelvic floor exercising comprising:

an anchor adapted for insertion into a user's body;

a cord coupled to the anchor and adapted to extend external to the user's body when the anchor is inserted internal to the user's body; and a weight system adapted to be removably coupled to the cord, wherein the weight system comprises a first weight comprising a through-hole and a slot extending therefrom that allows the first weight to be threaded onto the cord while the anchor is coupled to the cord.

2. The system of claim 1, comprising a base at an end portion of the cord opposite the anchor, wherein the base includes a maximum diameter normal to an axis of the end portion of the cord that is larger than a maximum diameter of the through-hole.

3. The system of claim 1, wherein the weight system includes a second weight, the second weight having a different weight or the same weight as compared to a weight of the first weight.

4. The system of claim 3, wherein the second weight comprises a through-hole and a slot extending therefrom that allows the second weight to be threaded onto the cord and onto the first weight while the anchor is in use.

5. The system of claim 4, wherein the second weight comprises a lower external surface that geometrically aligns with an upper external surface of the first weight such that they nest together when coupled to the cord.

6. The system of claim 4, wherein the second weight and first weight are configured to be threaded onto the cord simultaneously.

7. The system of claim 3, wherein the second weight has a lower surface that is stacked on an upper surface of the first weight in a nesting manner.

8. The system of claim 7, wherein the second weight comprises a different size than the first weight.

9. The system of claim 1 wherein the anchor has a shape of at least one of an egg shape, peanut shape, elongated shape, tear drop shape, spherical, spheroid, cylindrical, and conical.

10. The system of claim 1, wherein the first weight has at least one of a cone shape and an egg shape.

11. The system of claim 1, wherein the first weight comprises a bottle cap adaptor.

12. The system of claim 1, wherein the anchor and the cord are integrally formed.

13. The system of claim 1, wherein the cord includes a base adapted to enable coupling of the first weight to the cord, wherein the first weight comprises an internal cavity enclosing the base when the weight is coupled to the cord.

14. A method of performing pelvic floor exercises, the method comprising:

inserting an anchor internally to a user's body with an attached cord extending external to the user's body;

attaching a first weight comprising a through-hole and a slot extending therefrom to the cord; and allowing the weight to hang freely while holding the anchor using pelvic muscles of the user, wherein attaching the first weight comprises threading the through-hole and the slot onto the cord while the anchor is coupled to the cord.

15. The method of claim 14 further comprising assuming an exercise position that includes at least one of standing, squatting, and kneeling.

16. The method of claim 14 further comprising resisting the hanging weight until muscle fatigue is achieved.

17. The method of claim 16, further comprising repeating the method with a second weight on the cord.

18. The method of claim 14 further comprising swinging the freely hanging weight.

19. The method of claim 14, wherein the cord comprises a base at an end portion of the cord opposite the anchor, wherein the base includes a maximum diameter normal to an axis of the end portion of the cord that is larger than a maximum diameter of the through-hole, and wherein attaching the first weight to the cord comprises seating the base in an internal cavity of the first weight.

20. The method of claim 14, comprising attaching a second weight to the cord, wherein the second weight comprises a through-hole and a slot extending therefrom, and attaching the second weight comprises threading the second weight onto the cord while the anchor is coupled to the cord.

21. The method of claim 20, comprising nesting the first weight and the second weight together prior to attaching the first weight and the second weight to the cord, wherein attaching the first weight is done simultaneously with attaching the second weight to the cord.

* * * * *